US005344081A

United States Patent [19]

Wakeman

[11] Patent Number: 5,344,081

[45] Date of Patent: Sep. 6, 1994

[54] INJECTOR VALVE SEAT WITH RECIRCULATION TRAP

[75] Inventor: Russell J. Wakeman, Newport News, Va.

[73] Assignee: Siemens Automotive L.P., Auburn Hills, Mich.

[21] Appl. No.: 117,888

[22] Filed: Sep. 7, 1993

Related U.S. Application Data

[63] Continuation of Ser. No. 861,709, Apr. 1, 1992, abandoned.

[51] Int. Cl.[5] ..... F02M 51/06

[52] U.S. Cl. ..... 239/585.4; 239/533.12; 239/585.1; 239/900

[58] Field of Search ..... 239/533.2, 533.3, 533.12, 239/585.1, 585.2, 585.3, 585.4, 584, 900

[56] References Cited

U.S. PATENT DOCUMENTS

| | | | |
|---|---|---|---|
| 4,030,668 | 6/1977 | Kiwior | 239/900 X |
| 4,621,772 | 11/1986 | Blythe et al. | 239/585.4 |
| 4,646,974 | 3/1987 | Sofianek et al. | 239/900 X |
| 4,925,111 | 5/1990 | Foertsch et al. | 239/585.1 X |
| 4,934,605 | 6/1990 | Hans et al. | 239/900 X |
| 4,971,254 | 11/1990 | Daly et al. | 239/533.12 X |
| 5,044,563 | 9/1991 | Mesenich | 239/585.4 |
| 5,062,573 | 11/1991 | Makimura | 239/533.12 |
| 5,174,505 | 12/1992 | Shen | 239/585.1 |

FOREIGN PATENT DOCUMENTS

| | | | |
|---|---|---|---|
| 0229051 | 12/1984 | Japan | 239/900 |

*Primary Examiner*—Andres Kashnikow
*Assistant Examiner*—William Grant
*Attorney, Agent, or Firm*—George L. Boller; Russel C. Wells

[57] ABSTRACT

An improvement in fuel flow through orifices of a thin disc orifice member is obtained by incorporating a radially inwardly open undercut in the seat member below the frustoconical seating surface and above the thin disc orifice member. The undercut provides a space that allows a fuel recirculation zone to be displaced further radially outwardly so that it poses less of an obstruction to flow toward the orifice.

7 Claims, 3 Drawing Sheets

INJECTOR VALVE SEAT WITH RECIRCULATION TRAP

This is a continuation of copending application(s) Ser. No. 07/861,709 filed on Apr. 1, 1992, now abandoned.

FIELD OF THE INVENTION

This invention relates generally to electromechanical actuated fuel injector valves for internal combustion engines. More specifically, it relates to means for improving the flow through a thin disc orifice member in consequence of the unexpected discovery of the existence of a certain recirculation of fuel in the injector's sack volume during certain conditions of injector operation. This recirculation causes the flow through the disc's orifice(s) to exhibit significantly different velocity vectors at different locations within each orifice. While the ideal flow through an orifice is perfectly axial, some of these velocity vectors show a significant radial velocity component that not only detracts from the axial flow but also laterally disperses the injected fuel. A sufficiently large amount of dispersion may wet an adjacent wall of a manifold runner downstream from the fuel injector's nozzle in a manner that is detrimental to exhaust emissions from the engine.

BACKGROUND AND SUMMARY OF THE INVENTION

The nozzle end of one type of electromechanical actuated fuel injector comprises a frustoconical valve seat that funnels to a central circular hole that is covered by a thin disc orifice member having one or more orifices. An internal actuating mechanism comprises a needle having a spherically contoured tip that is seated on and unseated from the valve seat to open and close the flow through the fuel injector. When the fuel injector is open to flow, fuel passes through the lift opening that is created between the needle tip and the valve seat by the lifting of the tip from the seat. From there the fuel flow converges toward and enters the central circular hole. The orifices in the thin disc member are at the bottom of this central circular hole, but out of the direction of the converging flow that enters the hole, and as a result, the fuel flow must bend in order to pass to the orifices, and bend fairly sharply at that.

The purpose of each orifice in the thin disc orifice member is to inject a stream of fuel that is perpendicular to the plane of the orifice in accordance with a pressure vs. flow characteristic of the orifice. Such orifice members have heretofore been constructed as a flat disc that is disposed perpendicular to the main axis of the injector so that fuel is injected from each orifice as a stream that is parallel to that axis, or as a disc that has a centrally protruding conical dimple containing one or more orifices so that fuel is injected from each such orifice as a stream that is non-parallel to the injector axis, but is aimed in a desired direction. In actuality, injection streams from the orifices of thin disc orifice members are not perfectly ideal, but rather exhibit some degree of divergence.

To the extent, if at all, that the flow through an orifice of a thin disc orifice member may have been considered to be other than perfectly uniform at any location around the orifice during certain conditions of injector operation, the degree and nature of possible non-uniformity appear not to have heretofore been fully appreciated. The present invention is a result of the quite remarkable and unexpected discovery that for at least certain conditions of operation of certain fuel injectors, particularly at low injector lifts, there exists a rather startling disparity in fuel velocity vectors across an orifice. It is believed that this phenomenon is a consequence of the injector geometry that requires the flow to make the rather sharp bend described above as it passes from the lift opening to the orifice.

The nature of this phenomenon, which has been developed analytically and confirmed by empirical observation, involves the creation of a zone in which a portion of the liquid fuel flowing toward an orifice is recirculated before reaching the orifice. This recirculation may be considered as an eddy that, as it approaches the orifice, curves radially outwardly away from the orifice, then curves axially upwardly along the wall of the central circular hole, and then curves radially inwardly and finally again axially downwardly toward the orifice.

Briefly, the invention comprises the inclusion of an undercut in the central circular hole between the downstream terminus of the frustoconical seating surface and the thin disc orifice member. The undercut provides a space for the recirculation zone with the result that the recirculation zone is displaced farther radially outwardly thereby diminishing its adverse influence on the flows through the orifices of the thin disc orifice member.

The foregoing, along with further details and other advantages and benefits of the invention, will be seen in the ensuing description and claims which should be considered in conjunction with the accompanying drawings. The drawings disclose a presently preferred embodiment of the invention according to the best mode contemplated at this time for carrying out the invention.

DESCRIPTION OF THE PREFERRED EMBODIMENT

Figure 1:
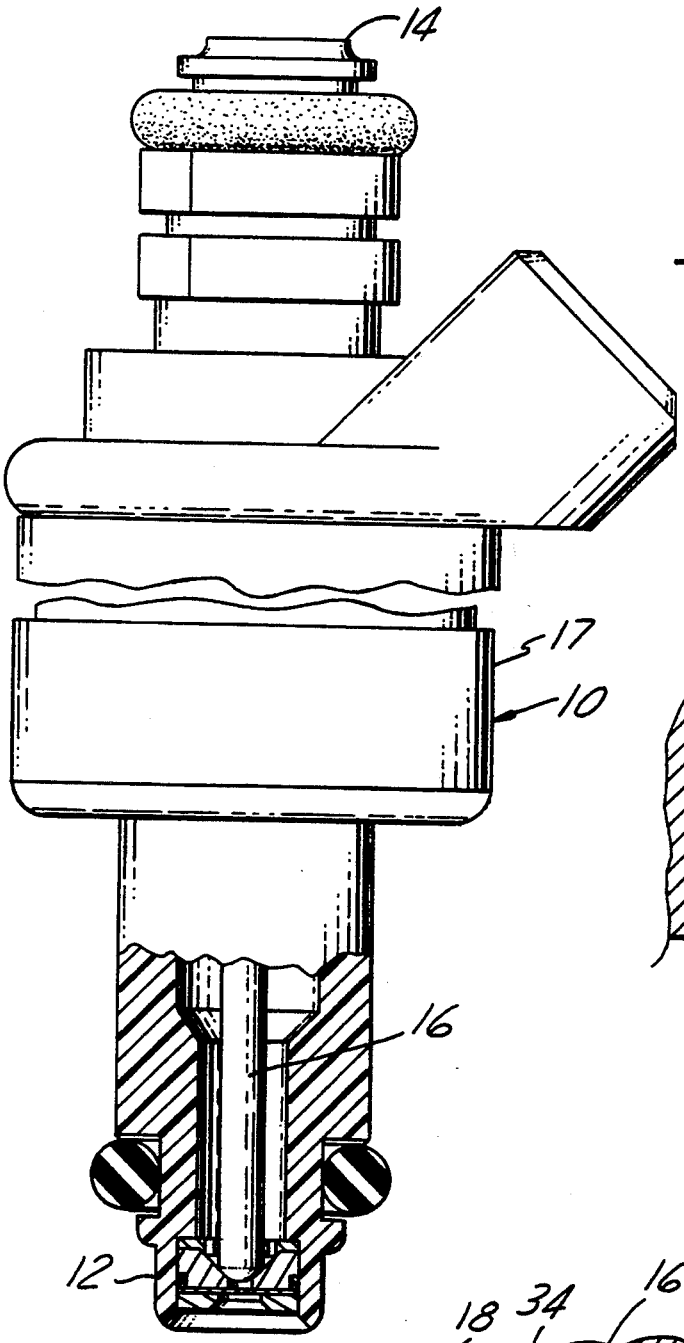
FIG. 1 (Prior Art)
FIG. 1 is a longitudinal view, having portions sectioned away, of a known electromechanical fuel injector into which the present invention may be advantageously incorporated.
Figure 2:
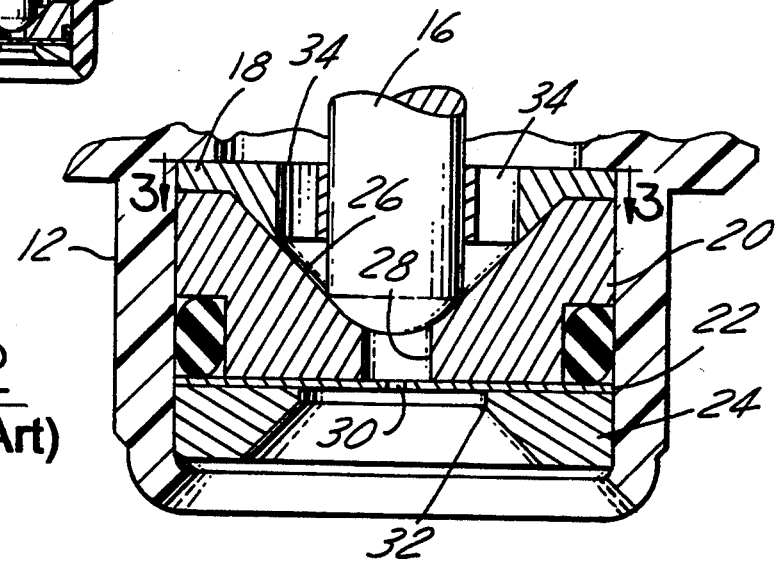
FIG. 2 (Prior Art)
FIG. 2 is an enlarged view of the nozzle end of the fuel injector of FIG. 1.

FIGS. 1 and 2 show a known representative fuel injector 10 into which the present invention may be advantageously incorporated. It is a top feed type having a nozzle 12 at its lower end and an inlet 14 at its upper end. The internal operating mechanism comprises means for axially reciprocating a needle 16 by the selective energization and de-energization of a solenoid 17. The construction for nozzle 12 comprises a needle guide member 18, a seat member 20, a thin disc orifice member 22, and a retainer 24, stacked and captured within the nozzle. Seat member 20 has a frustoconical seating surface 26 with which the spherically contoured tip end of needle 16 coacts. FIGS. 1 and 2 show the needle seated, thereby closing a central circular hole 28 that extends through member 20 from the lower terminus of seating surface 26. Member 22 is disposed against the lower face of member 20 and comprises one or more orifices 30 in communication with hole 28. Member 24 contains a much larger hole 32 communicating with orifice(s) 30. Needle guide member 18 has a central circular hole 25 that aids in guiding the axial reciprocation of needle 16 to and from seating surface 26. It also has several holes 34 that provide for liquid fuel that has been introduced into the interior of the fuel injector via inlet 14 to flow to the space between the needle and the seating surface.

When the fuel injector is operated to unseat, or lift, needle 16 from seating surface 26, a lift opening is created between the spherically contoured tip end of the needle and the seating surface. Fuel flows through this opening, passing in the direction of the convergence of the seating surface to enter hole 28. It continues through the hole and injected from the injector via orifice(s) 30.

Figure 3:
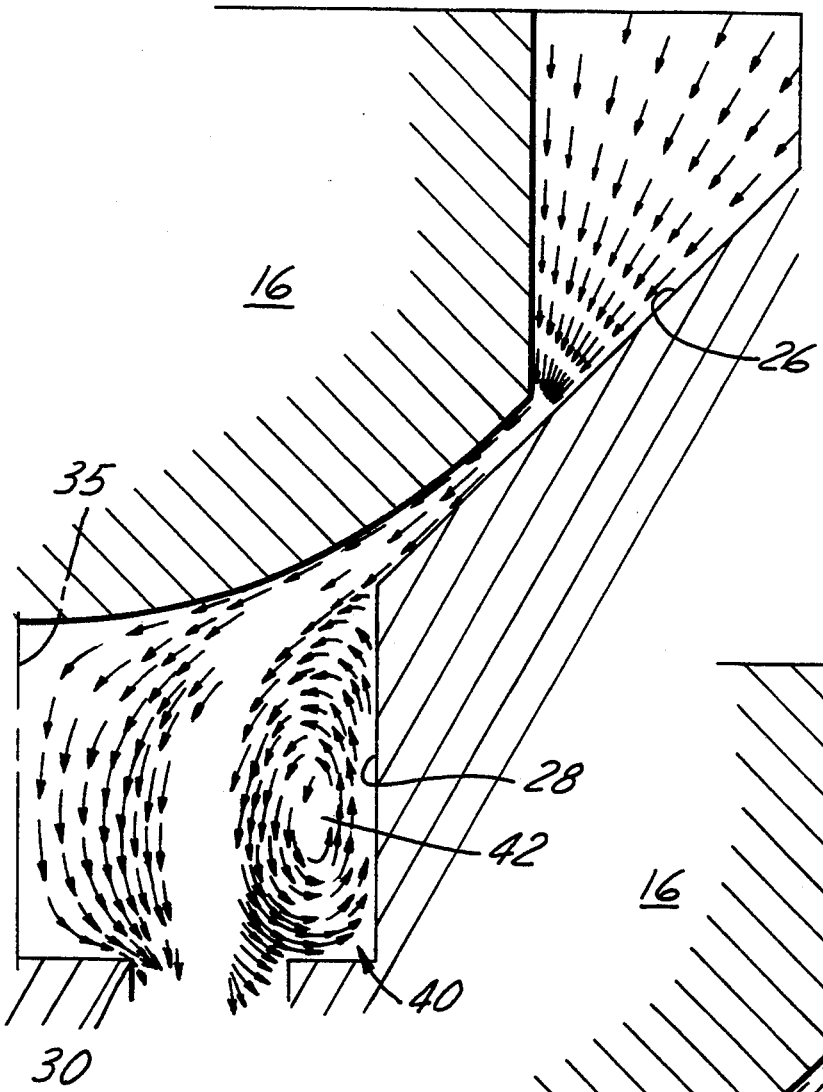
FIG.3 (Prior Art)
FIG. 3 is an enlarged view of a portion of FIG. 2 illustrating typical flow vectors for a certain amount of valve lift.

FIG. 3 shows a representative steady state flow for a certain amount of valve lift. Upstream of the lift opening, the flow velocity vectors point toward the lift opening and become increasingly larger in magnitude as the flow approaches the lift opening. Thus, the fuel flow accelerates as it approaches and passes through the lift opening. FIG. 3 shows an orifice disc wherein the illustrated orifice 30 is not coaxial with the centerline 35 of the injector. Consequently, the fuel flow is required to execute a bend as it enters and passes through hole 28.

It has been discovered that the flow velocity through orifice 30 is not uniform over the orifice's flow area. In particular the flow vectors show the existence of a recirculation zone 40 that has an approximate center at 42. Thus fuel that approaches approximately the right one-third of the orifice as viewed in FIG. 3 does so with velocity that has a significant radial component and an axial component that is noticeably diminished from the axial velocities of flow through approximately the center one-third of the orifice. The flows at approximately the left one-third of the orifice have a noticeable radial component as they approach the orifice, but they tend to straighten out as they pass through the orifice. It is believed reasonably fair to conclude that the recirculating flow is caused by the need for the flow to execute a bend in making the transition from the seat member to the orifice. The recirculation zone is the result of some of the fuel approaching the orifice being recirculated as an eddy before it reaches the orifice thereby tending to reduce fuel flow through one portion of said orifice in comparison to fuel flow through another portion of said orifice.

Figure 4:
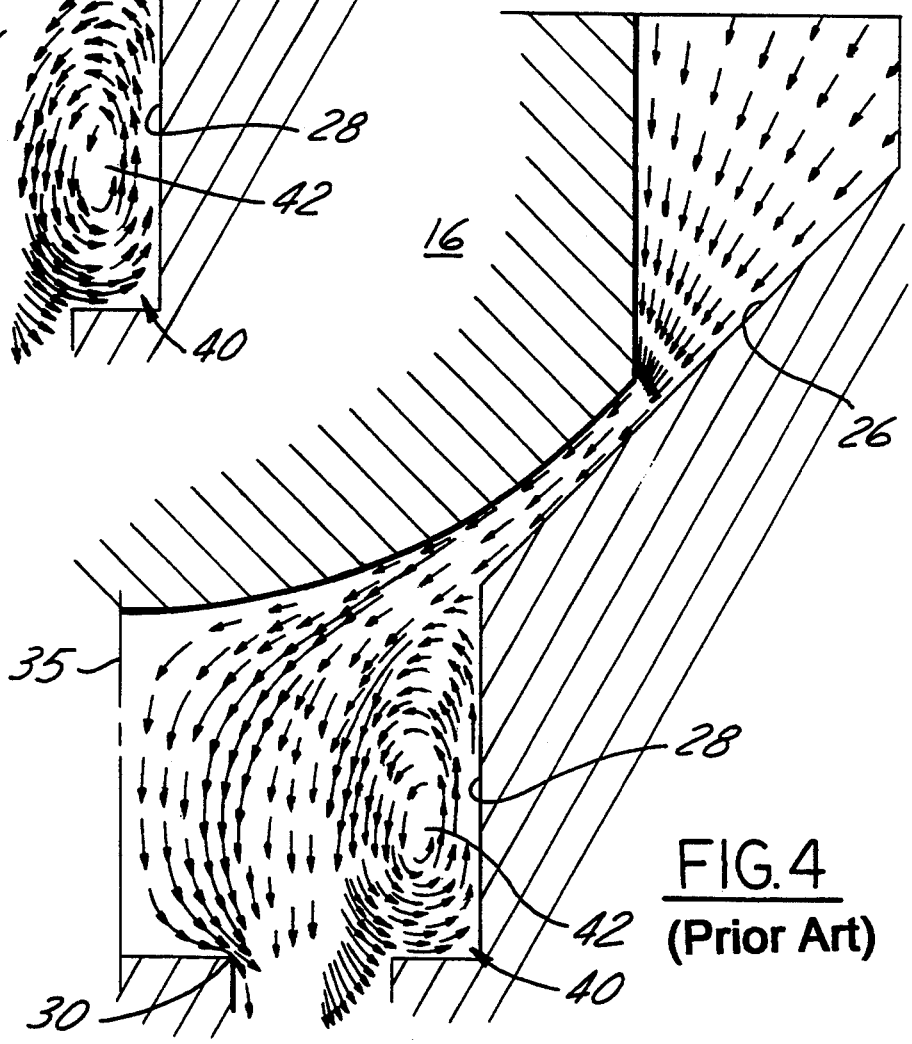
FIG.4 (Prior Art)
FIG. 4 is a view like FIG. 3, but for a greater amount of valve lift.

FIG. 4 shows the same phenomenon for a somewhat greater lift than that of FIG. 3.

Figure 5:
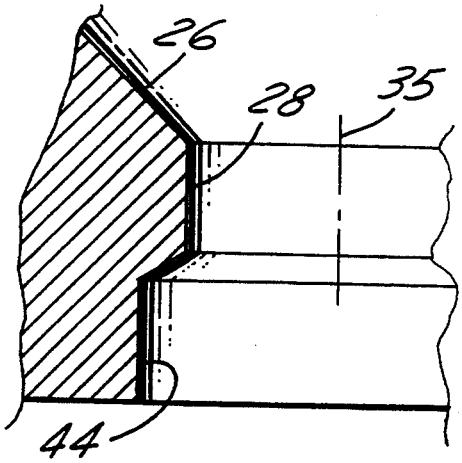
FIG. 5 is a fragmentary cross sectional view of a detail of a representative modification to the fuel injector, in accordance with the invention.

The invention comprises a solution for ameliorating the tendency toward reduced flow through one portion of the orifice on account of such recirculation zone. It comprises the inclusion of an undercut 44 in member 20, such as depicted by FIG. 5. The undercut lies between seating surface 26 and orifice 30 and has a size and shape that provides for a substantial portion of the recirculation zone to occupy the undercut. This effectively displaces the recirculation zone in a direction out of the path of the bend in the fuel flow so as to cause the flow through the righthand portion of the orifice to more closely approach the flow through the lefthand portion. The undercut comprises a frustoconically expanding portion following by a circular groove. The undercut is coaxial with the axis of seating surface 26, is radially inwardly open, and is disposed radially outwardly of the orifice and axially between the seating surface and the orifice.

Figure 6:
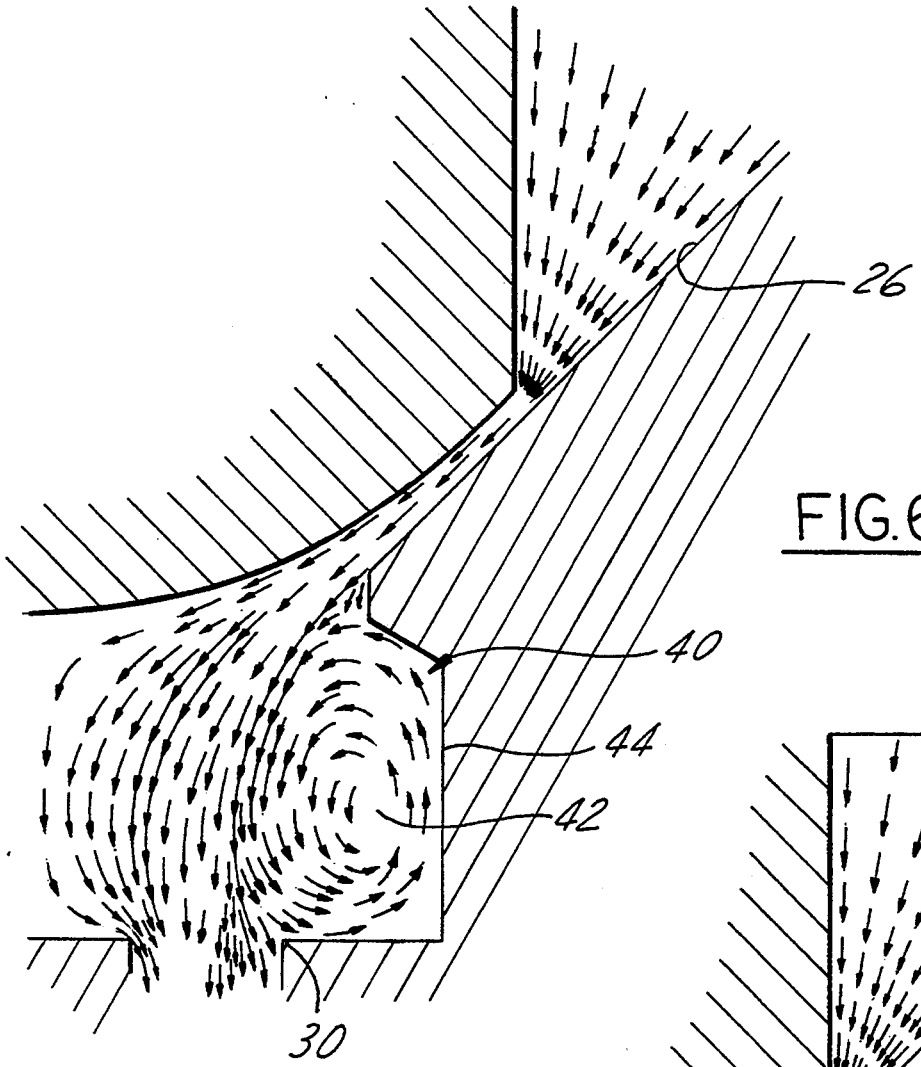
FIG. 6 is a view for substantially the same amount of valve lift as that of FIG. 3, but with the modification of FIG. 5 having been incorporated into the fuel injector.
Figure 7:
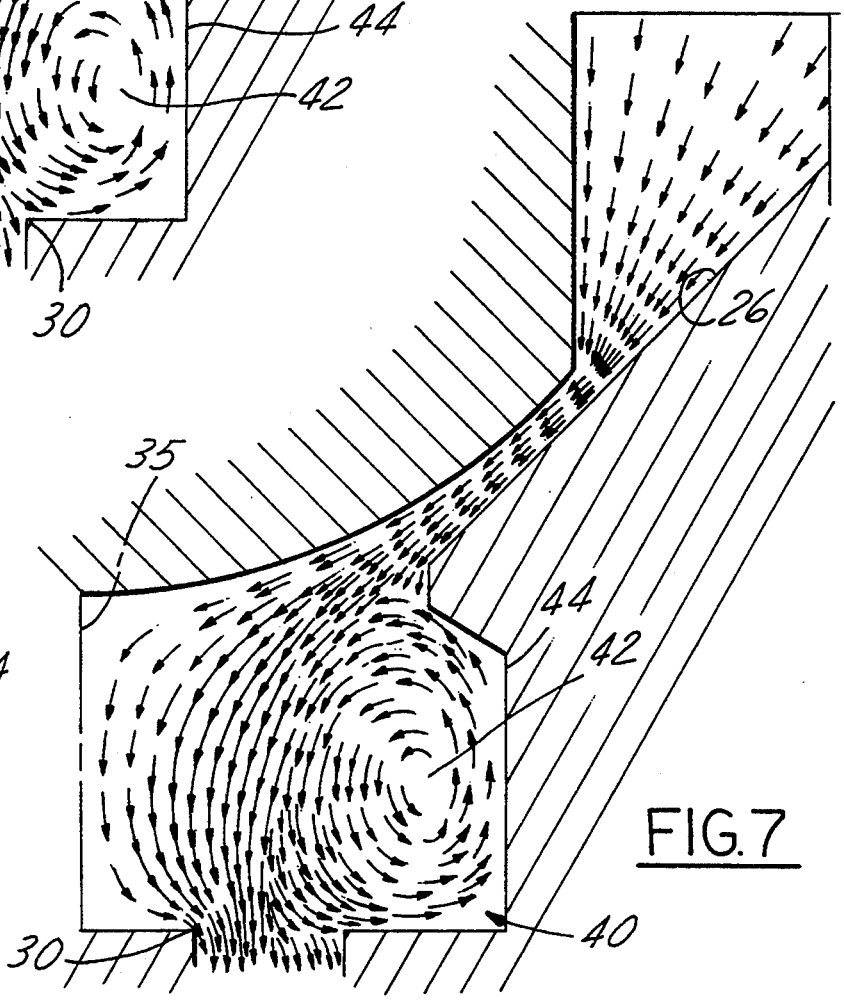
FIG. 7 is a view for substantially the same amount of valve lift as that of FIG. 4, but with the modification of FIG. 5 having been incorporated into the fuel injector.

Representative improvement that is obtained by the incorporation of the undercut is depicted by FIGS. 6 and 7 which should be compared against FIGS. 3 and 4 respectively. While the recirculation zone is still present, its center is displaced outwardly beyond the orifice by virtue of incorporating the invention into the fuel injector. The result is a more uniform flow over the flow area of the orifice.

Figure 8:
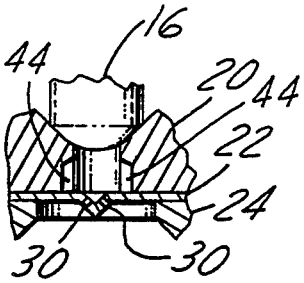
FIG. 8 is a fragmentary view of another form of nozzle end.

FIG. 8 shows another form of nozzle end where member 22 contains a centrally protruding conical dimple containing plural orifices 30 circumferentially spaced apart from each other so that fuel is injected from each as a stream that is non-parallel to the fuel injector's axis.

It should be understood that the illustrated embodiment and resulting improvement are representative. While a presently preferred embodiment has been illustrated and described, principles are applicable to other embodiments.

What is claimed is:

1. A fuel injector comprising a body having an inlet at which pressurized liquid fuel is delivered to the fuel injector, a nozzle from which the fuel injector injects fuel, passage means for conveying fuel from said inlet to said nozzle, said nozzle comprising an orifice through which fuel is injected from the nozzle, said passage means comprising a seating surface that is disposed upstream of said orifice proximate said orifice and that converges in the downstream direction to give at the narrowest convergence of said seating surface a diameter that is spaced upstream and radially outwardly of said orifice, an electromechanically actuated mechanism comprising a valve member that is operated to selectively seat on and unseat from said seating surface and thereby allow and disallow fuel to be injected through said orifice, said seating surface and said valve member being constructed to have a coaction that, when said valve member is unseated from said seating surface to define a lift opening between them, directs the fuel in the direction of the convergence of said seating surface, said orifice being disposed out of the direction of the convergence of said seating surface such that fuel that has already passed through said lift opening and is flowing in the direction of convergence of said seating surface is required to execute a bend that diverges from the direction of the convergence of said seating surface before it passes through said orifice resulting in the creation of a fuel recirculation zone, said recirculation zone being characterized by some of the fuel approaching said orifice being recirculated as an eddy before it reaches said orifice, said passage means being formed as an undercut in the region of said recirculation zone, said undercut being disposed between said seating surface and said orifice and comprising a frustoconically expanding portion followed by a circular groove in the direction of said orifice, wherein a substantial portion of the recirculation zone occupies said undercut, such that the recirculation zone is displaced in a direction out of the path of said bend, thereby reducing a tendency of reduced fuel flow through one portion of said orifice in comparison to fuel flow through another portion of said orifice as a result of said eddy, whereby the flow through said one portion of said orifice more closely approaches the flow through said another portion of said orifice.

2. A fuel injector as set forth in claim 1 characterized further in that said seating surface and said undercut are embodied in a common part that is assembled into the fuel injector.

3. A fuel injector as set forth in claim 2 characterized further in that said orifice is in a thin disc orifice member that is assembled into the fuel injector and is disposed against said part.

4. A fuel injector as set forth in claim 3 characterized further in that said fuel injector has a main longitudinal axis and said orifice lies in a plane that is perpendicular to that axis.

5. A fuel injector as set forth in claim 3 characterized further in that said fuel injector has a main longitudinal axis and said orifice lies in a plane that is non-perpendicular to that axis.

6. A fuel injector as set forth in claim 3 characterized further in that said fuel injector has a main longitudinal axis and said thin disc orifice member comprises plural such orifices arranged circumferentially spaced apart from each other about that axis.

7. A fuel injector as set forth in claim 1 characterized further in that the upstream terminus of said undercut is spaced axially of the downstream terminus of said frustoconical seating surface.

* * * * *